US006288640B1

(12) United States Patent
Gagnon

(10) Patent No.: US 6,288,640 B1
(45) Date of Patent: Sep. 11, 2001

(54) OPEN TRANSMISSION LINE INTRUSION DETECTION SYSTEM USING FREQUENCY SPECTRUM ANALYSIS

(76) Inventor: André Gagnon, 15 Des Cerisiers, Hull, Quebec (CA), J9A 2W7

( * ) Notice: Subject to any disclaimer, the term of this patent is extended or adjusted under 35 U.S.C. 154(b) by 0 days.

(21) Appl. No.: 09/077,980

(22) PCT Filed: Dec. 13, 1996

(86) PCT No.: PCT/CA96/00840

§ 371 Date: Jun. 15, 1998

§ 102(e) Date: Jun. 15, 1998

(87) PCT Pub. No.: WO97/22955

PCT Pub. Date: Jun. 26, 1997

(30) Foreign Application Priority Data

Dec. 15, 1995 (CA) ..... 2165384

(51) Int. Cl.[7] ..... G08B 1/08

(52) U.S. Cl. ..... 340/539; 340/506; 340/511; 340/526; 340/541

(58) Field of Search ..... 340/511, 506, 340/517, 521, 523, 526, 541, 825.73

(56) References Cited

U.S. PATENT DOCUMENTS

| | | | | |
|---|---|---|---|---|
| 3,163,861 | | 12/1964 | Suter | 343/14 |
| 4,562,428 | | 12/1985 | Harman et al. | 340/552 |
| 4,684,929 | * | 8/1987 | Edwards et al. | 340/541 |
| 5,854,588 | * | 12/1998 | Dockery | 340/541 |

FOREIGN PATENT DOCUMENTS

| | | | |
|---|---|---|---|
| 39 17897 A1 | 12/1990 | (DE) | G01R/29/08 |
| 2182474 | 5/1987 | (GB) | G08B/13/24 |
| WO 94/0222 | 3/1994 | (WO) | G08B/13/24 |

OTHER PUBLICATIONS

Synergistic Radar: Radioguard Application and Performance, K. Harman et al, Proceedings of the International Carnahan Conference on Security Technology, Taipei, Oct. 1113–15, 1993, pp. 139–142.

Synergistic Radar: Novel Applications and Performance, A. Gagnon et al, Proceedings of the Annual International Carahan Conference on Security Technology, Albuquerque, Oct. 12, 1994, pp. 26–30.

* cited by examiner

*Primary Examiner*—Daryl Pope
(74) *Attorney, Agent, or Firm*—Thomas Adams

(57) ABSTRACT

An intrusion detection system comprises a plurality of sensors (2A . . . 2X) and a corresponding plurality of receivers (3A. . . 3X). Each receiver receives, via the associated sensor, radio frequency signals comprising a multiplicity of transmissions at different frequencies within a predetermined frequency spectrum. The receiver detects the radio frequency signals and computes, for each of a plurality of successive time intervals and for each of the transmission frequencies, a measurement of signal amplitude over the time interval; compares such signal amplitude measurement with at least one threshold and, if the amplitude exceeds the threshold for a predetermined time period, generates a potential alarm signal. A processor (4) compares potential alarm signals from a plurality of sensors and determines that an intrusion has occurred if the potential alarm signal for a particular station does not coincide with a potential alarm signal for a neighboring sensor. Each receiver may output an intruder alarm signal when potential alarm signals occur simultaneously for more than a preset number of a multiplicity of the transmission frequencies.

16 Claims, 12 Drawing Sheets

OPEN TRANSMISSION LINE INTRUSION DETECTION SYSTEM USING FREQUENCY SPECTRUM ANALYSIS

DESCRIPTION

1. Technical Field

The invention relates to intrusion detection systems and is especially applicable to systems which comprise an "open" transmission line, for example a so-called "leaky" or "ported" cable, for receiving a radio frequency signal and a receiver attached to the open transmission line for processing the received radio frequency signal to detect perturbations caused by an intruder in proximity to the open transmission line.

2. Background Art

Examples of such intrusion detection systems are disclosed in U.S. Pat. No. 3,163,861 (Suter) issued Dec. 29, 1964, U.S. Pat. No. 3,794,992 (Gehman) issued Feb. 26, 1974, U.S. Pat. No. 4,419,659 (Harman et al) issued Dec. 6, 1983, U.S. Pat. No. 4,887,069 (Maki) issued Dec. 12, 1989 and international patent application number PCT/CA93/00366 (Harman et al) published Mar. 31, 1994.

To increase detection rates, the system disclosed by Gehman compares the signals from two adjacent cables, one via a quarter-wavelength section. Such duplication entails additional expense.

To avoid "null" problems which arise when an intruder crosses the line at a certain angular position, the system disclosed in international patent application number PCT/CA93/00366 uses two receivers, one at each end of the cable. The receivers are coupled to a reference antenna which receives a FM radio frequency signal directly from a nearby commercial radio transmitter and use synchronous detection to extract amplitude and phase modulation caused by the intruder and determine from them the presence of the intruder. At a fixed frequency, an intruder could cause a maximum amplitude modulation with minimum phase modulation or, conversely, maximum phase modulation with minimum amplitude modulation. Consequently, in order to maintain uniform detection along the line, the receivers use full vector demodulation of the in-phase (I) and quadrature (Q) components, where amplitude is $\sqrt{(I^2+Q^2)}$ and phase is arc tg (Q/I).

The additional expense of such systems can be tolerated by "high end" users protecting very expensive property or high security areas such as military bases and correctional facilities. Such sites are likely to be serviced also by video surveillance systems or full time guards on site, so increased false alarm rates resulting from using sensors designed to give maximum probability of detection can be tolerated.

There is a need, however, for "low end" intrusion detection systems which are relatively inexpensive. For a particular site, system cost can be reduced by increasing the length of the open transmission line to limit the number of relatively expensive receivers and processors needed. A disadvantage of this approach, however, is that long sensor lines can increase the likelihood of undetected intrusion. Thus, attenuation along the length of the line may make it difficult to set the sensitivity so that the system will detect an intruder at the far end of the line while not being overloaded by perturbations caused by an intruder near to the receiver. Graded cables could be used to overcome this problem, but they are relatively expensive. Another disadvantage of long sensor lines concerns the need to allow legitimate access to a protected area such as a compound. When a sensor line across the entrance to a compound is switched off to allow a vehicle to enter, for example, the risk of an intruder gaining access at the same time is greater for longer sensor lines. Other problems which are exacerbated by longer sensor lines include variations in sensitivity caused by differing media along the length of the line; objects moving within the protected area; and increased range capability for any video monitors used in conjunction with the system.

DISCLOSURE OF INVENTION

The present invention seeks to eliminate, or at least mitigate, one or more of the disadvantages of known intrusion detection systems and to provide an intrusion detection system which is relatively inexpensive yet reliable.

According to the present invention, an intrusion detection system comprises a plurality of sensors coupled to a corresponding plurality of receivers, each receiver to receive a radio frequency signal from the associated sensor, the radio frequency signal having a multiplicity of transmissions at different frequencies within a predetermined frequency spectrum, the receiver being arranged to detect said transmissions and having computing means for determining, for each of said multiplicity of transmissions, corresponding signal amplitude measurements, comparing each of such signal amplitude measurements for a particular frequency with at least one preset threshold value and, if the amplitude exceeds the threshold for a predetermined time period, indicating a potential alarm condition.

The receiver may include means for scanning an FM radio spectrum and selecting a number of said transmission frequencies, and computing means for sampling the amplitude of the FM radio signal received from the associated sensor over a predetermined time interval, each sample being said signal amplitude measurement, derive statistics of a plurality of said samples over each of successive time periods, and adjust the preset threshold value periodically in dependence upon said statistics.

The computing means may also derive higher and lower variance values of the amplitudes of the plurality of samples and use such variance values to determine respective upper and lower thresholds delimiting a range of acceptable amplitude values, and generate the potential intruder alarm signal when said measurement of signal amplitude is outside the range. The computing means then updates the threshold values periodically on the basis of mean and variance values computed for a predetermined number of samples.

The intrusion detection system may further comprise a common processor for receiving station alarm signals from the plurality of receivers, comparing station alarm signals for a particular sensor and corresponding station alarm signals of at least one of its immediately neighbouring sensors, and generating a system intrusion alarm signal when the station alarm signals for the particular sensor do not occur contemporaneously with the corresponding station alarm signals for said at least one of the neighbouring sensors.

The common processor may be arranged to generate the station alarm signal only when the signal amplitude measurements for a predetermined proportion of the multiplicity of station transmissions exceed their respective threshold values in the same time interval.

Each sensor may comprise an open transmission line, the open transmission lines being concatenated by the plurality of receivers, a first of the receivers being connected to the common processor for processing signals from the different receivers, each of the receivers other than the first receiver interconnecting two of the open transmission lines, each receiver being arranged to transmit station alarm signals to the common processor by way of any intervening open transmission lines and receivers.

The common processor may supply power to the receivers by way of intervening transmission line(s) and/or receivers.

One or more of the sensors may comprise a localized antenna acting as a single point in space instead of a distributed antenna in the form of an open transmission line.

The intrusion detection system may comprise a plurality of sub-systems sharing the common processor, the sub-systems being physically separated from each other. The sub-systems and the common processor may then have respective transceivers for communicating station alarm signals and control signals between each sub-system and the common processor.

Various objects, features, aspects and advantages of the present invention will become more apparent from the following detailed description, taken in conjunction with the accompanying drawings of preferred embodiments of the invention, which are described by way of example only.

BEST MODES FOR CARRYING OUT THE INVENTION

Figure 1:
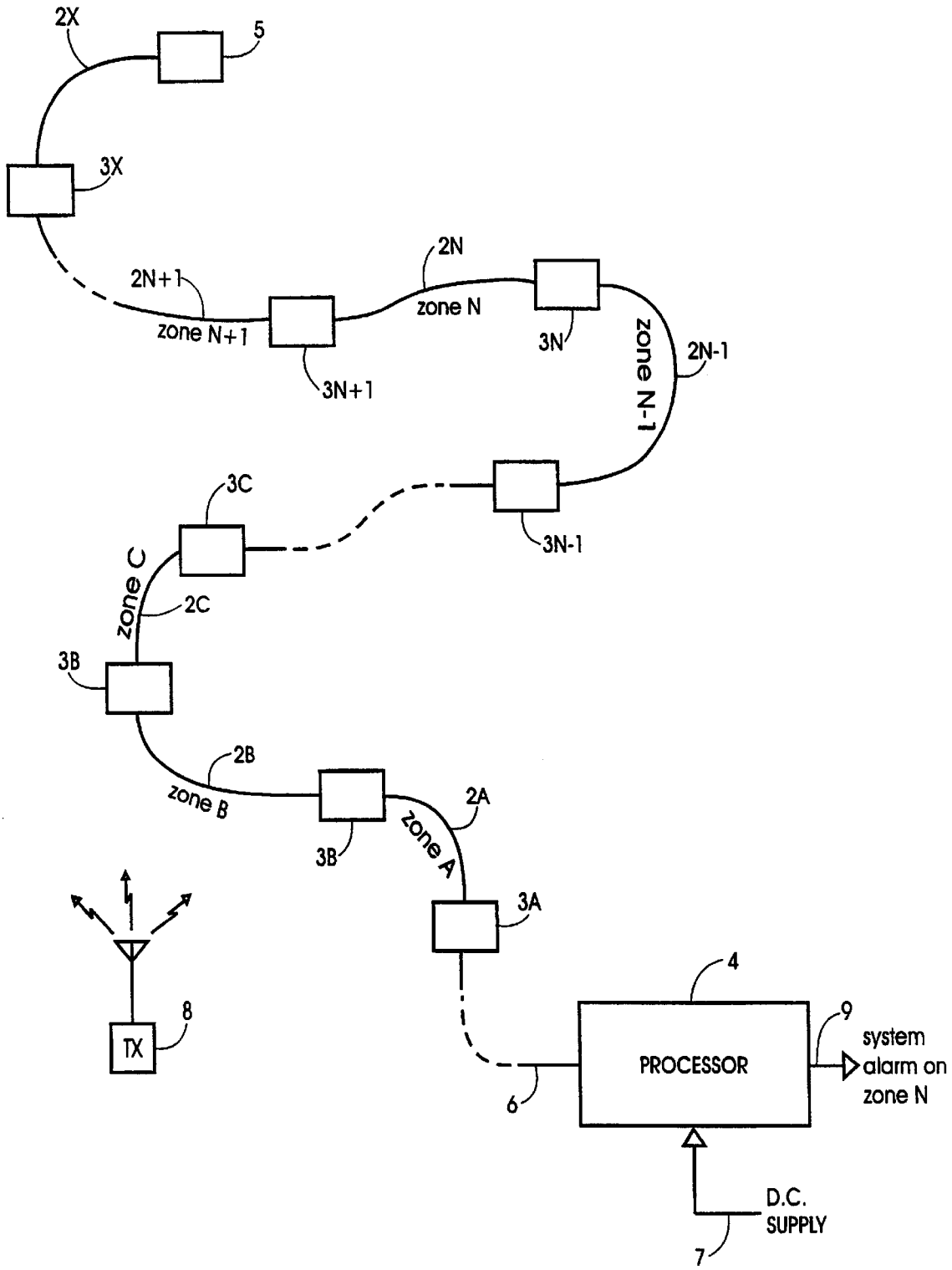
FIG. 1 is a schematic conceptual diagram of an intrusion detection system of a first embodiment of the invention comprising several open transmission line sensors and associated receivers.

Referring first to FIG. 1, an intrusion detection system comprises a series of similar open transmission lines in the form of so-called "leaky" or "ported" cables designated 2A, 2B, 2C . . . 2N . . . 2X and receivers, designated 3A, 3B, 3C . . . 3N . . . 3X, connected in series between a common processor 4 and a termination load 5 to form, in effect, a linear bus defining a corresponding series of protection zones A to X. The cables 2A . . . 2X serve as sensors. The common processor 4 is connected to the first receiver 3A by a feedline 6 and connected to a DC power supply by line 7. The common processor 4 relays DC power to the receivers 3 by way of the feedline 6 and cable or cables 2. The final cable 2X is connected at one end to the termination load 5 and at the other end to receiver 3X. A separate transmitter 8 broadcasts FM radio signals which are received by the cables 2A . . . 2X. Preferably, the transmitter 8 is a commercial FM radio station transmitter broadcasting a multiplicity of radio station transmissions having different frequencies within a predetermined frequency spectrum, typically 88 MHz. to 108 MHz. The transmitter could, however, be a part of the intrusion detection system and transmit a multiplicity of signals within a similar frequency spectrum. In this case, however, the transmissions would be unlikely to have FM modulation, as opposed to commercial radio station transmissions.

Each of the receivers 3A . . . 3X receives the radio frequency signal picked up by the associated one of cables 2A . . . 2X and scans the frequency spectrum; measures and digitizes the amplitude of each FM station detected; and processes the amplitude measurement of each station to determine a potential Station Alarm condition. If such a condition occurs in zone N, the receiver 3N transmits a "Station Alarm", via the intervening cable or cables (if applicable) and feedline 6 to the common processor 4 which determines correlation between Station Alarms of adjacent detection zones N+1 and N−1 to determine whether or not to output a "System Alarm on Zone N" signal on line 9.

Figure 2:
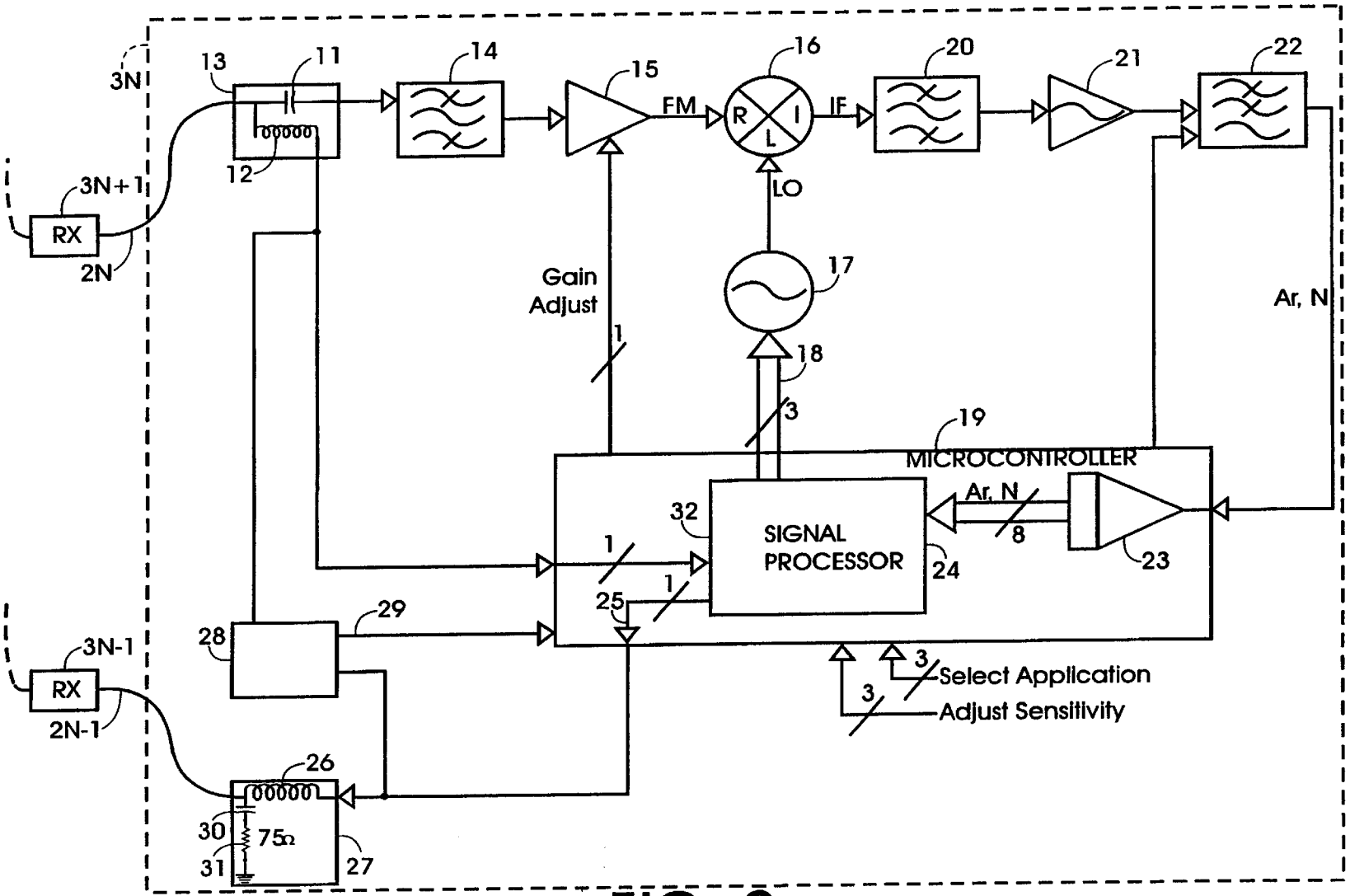
FIG. 2 is a schematic block diagram of one of the receivers.

The receivers 3A to 3X are identical so the construction and operation of only one of them, receiver 3N, will now be described. Referring to FIG. 2, in receiver 3N, the radio frequency signal received from the associated sensor cable 2N is coupled to the common connection of a capacitor 11 and inductor 12 of a bias-T circuit 13. The capacitor 11 couples the radio signal to a bandpass filter 14 which restricts the radio signal to the FM spectrum from 88 MHz. to 108 MHz. and passes it to a low noise amplifier 15. The amplified signal from amplifier 15 is down-converted to an intermediate frequency (IF) signal of 10.7 MHz. by a mixer 16 which derives its local oscillator signal (LO) from a phase-locked loop oscillator (PLO) 17. The PLO 17 is controlled, via bus 18, by a microcontroller 19 which causes the local oscillator frequency to scan the spectrum and detects the transmissions from up to ten FM radio stations.

For each transmission frequency, the down-converted IF signal from mixer 16 is filtered by a second bandpass filter 20 having a bandwidth of 300 kHz. centered upon the IF frequency. The magnitude of the output from second bandpass filter 20 is measured using a logarithmic amplifier 21. The analog signal from the logarithmic amplifier 21 represents the amplitude of the radio frequency signal for a selected station and is filtered by a low pass filter 22 having a cut-off of 80 Hz. The filtered signal Ar,N from low pass filter 22 is converted to an eight bit digital signal by analog-to-digital (A-to-D) converter 23 within the microcontroller 19. The digital signal from A-to-D converter 23 is processed by a signal processor 24 of the microcontroller 19, as will be described in more detail later. If it determines that an intruder may be present in zone N, i.e. a potential alarm condition, the signal processor 24 generates a "Station Alarm" signal for the particular station and supplies it by way of line 25 and a series inductor 26 of a second bias-T 27 onto the preceding cable 2N−1 for transmission to the common processor 4 via the receiver 3N−1 and the preceding receivers and cables. The signal processor 24 will add an address and time stamp for receiver 3N to the "Station Alarm" signal and, depending upon the network topology of the various receivers and cables, incorporate a network communication protocol.

D.C. power for the receivers 3A . . . 3X is transmitted from the common processor 4 via the cables 2A . . . 2X and feedline 6. As shown in FIG. 2, a 5 volt regulator 28 connected to inductor 26 of bias-T circuit 27 receives the D.C. power supply signal from cable 2N−1. The regulator 28 supplies a regulated voltage on line 29 to the various components of the receiver 3N and relays power supply signal via the inductor 12 of bias-T circuit 13 for coupling to the cable 2N for supply to the succeeding receivers.

The shunt arm of second bias-T circuit 27 comprises, in series with the usual capacitor 30, a 75 ohm resistor 31 to terminate the cable 2N−1 properly to ground.

The receiver 3N may also receive via cable 2N "Station Alarm" signals generated by receiver 3N+1 itself or generated by succeeding receivers up to 3X and relayed via receiver 3N+1. These signals are digital signals modulated onto a carrier of, for example, about 4 kilohertz. Being relatively low frequency, they are coupled by the inductor 12 of bias-T circuit 13 to input port 32 of the signal processor 24, which will combine them with its own "Station Alarm" signal, if any, for transmission to the common processor 4 via its communication line 25.

Upon receipt of a "Station Alarm" from any one of the receivers 3, the common processor 4 will compare the Station Alarm signals for adjacent zones. In the linear bus arrangement of FIG. 1, this will entail comparing with the signals from the immediately preceding and succeeding receivers, but other network tropologies, to be described later, may entail different comparisons. In essence, the signals from the other receivers serve as the reference for the receiver generating the "Station Alarm". Hence, unlike the system disclosed in international patent application number PCT/CA93/00366, there is no need for a separate reference antenna to receive the radio frequency signal direct from the transmitter antenna 8. In this case, each neighbouring zone serves as the reference antenna for the "center zone". Also, whereas the detection process described in PCT/CA93/00366 is coherent, the present detection technique is non-coherent, i.e. comparison does not involve synchronous detection of amplitude and phase but rather entails a form of frequency spectrum analysis (asynchronous detection of amplitude) particular to each zone.

Figure 3:
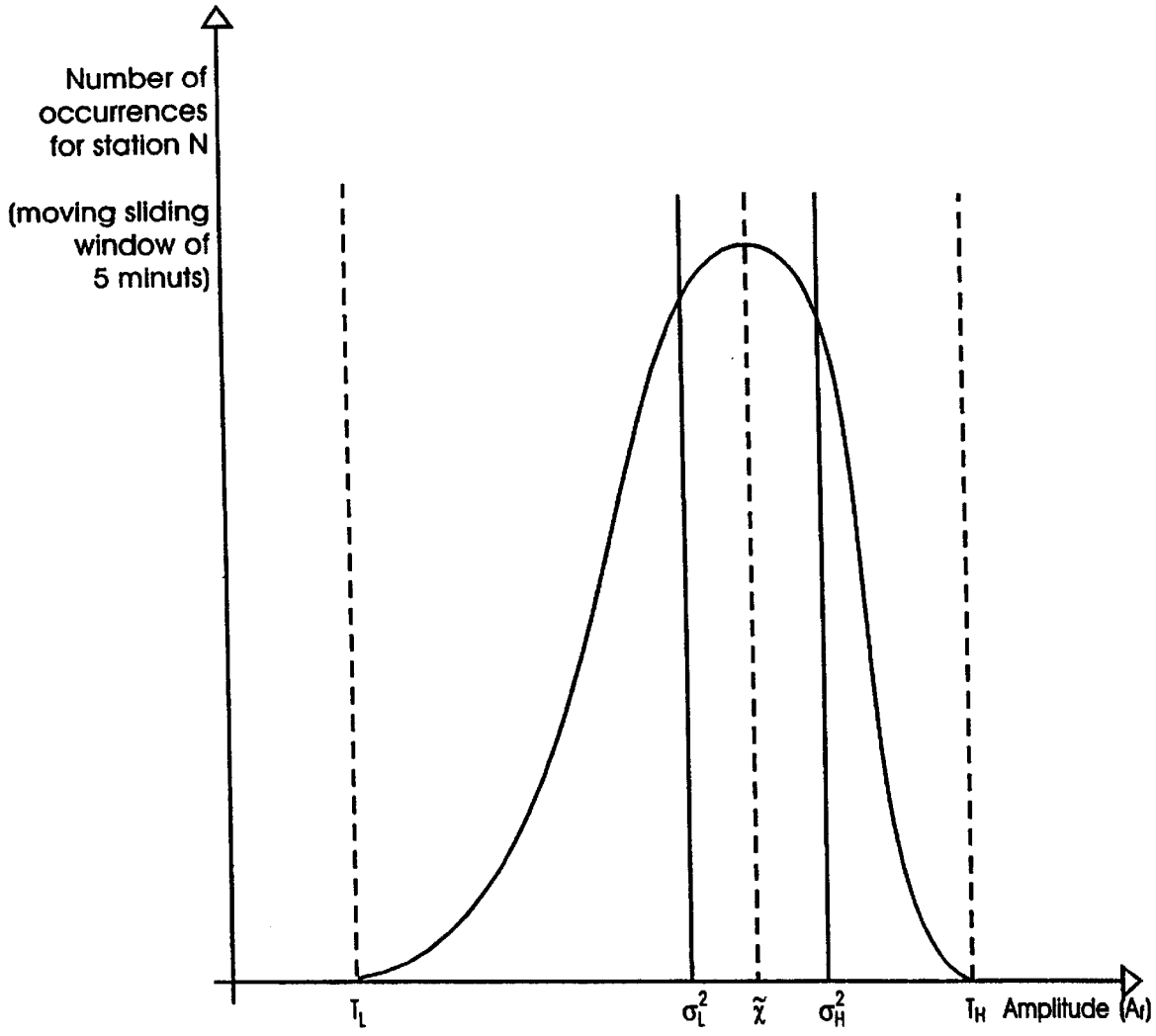
FIG. 3 is a statistical distribution of amplitude levels for an FM radio signal received by one of the receivers.
Figure 4:
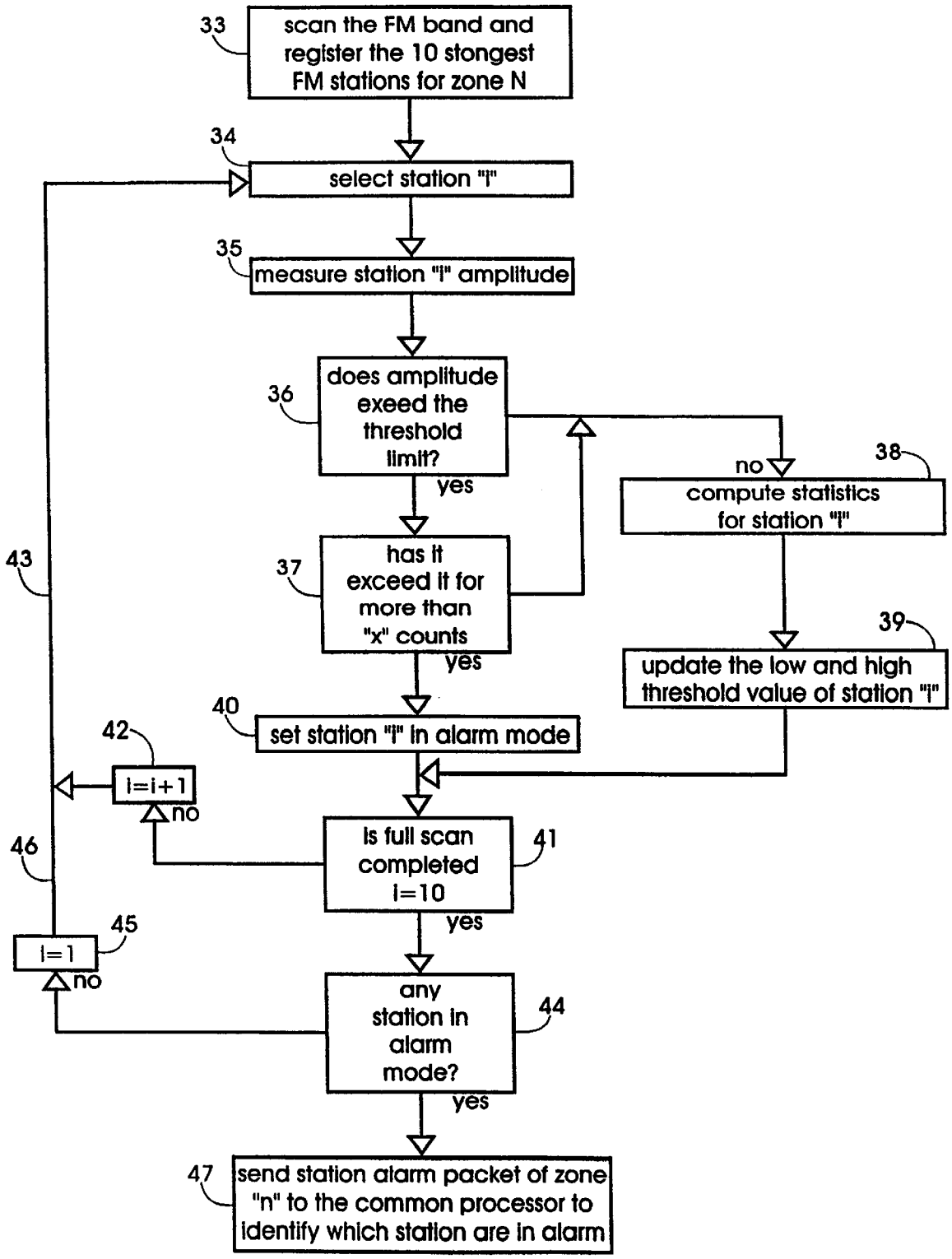
FIG. 4 is a flowchart depicting operation of one of the receivers.

The manner in which the system determines whether or not an intruder is present in zone N, i.e. surrounding cable 2N, will now be described with reference also to FIG. 3 and the flowchart of FIG. 4. In step 33, the microcontroller 19 adjusts the oscillator 17 to cause the receiver 3N to scan the frequency spectrum and register the ten stations having the strongest signals for zone N. In steps 34 and 35, the signal processor 24 selects the transmission frequency for station i and measures the amplitude $A_r$. The processor 24 filters the amplitude measurement using digital filtering techniques (not shown) to avoid false alarms caused by drift. The processor 24 then samples the filtered measurements $A_f$ as previously described and records the amplitudes of the samples. The receiver measures the amplitude $A_f$ of the signal over a period of about five minutes, sampling the signal at a rate of, say, 500 samples per second. The actual number of samples or sampling window will depend upon the particular application, taking account of factors such as environment, temperature drift, and so on. The resulting histogram is shown in FIG. 3 which plots the number of occurrences, in a moving window of, in this example, five minutes, against the filtered amplitude $A_f$ of a particular FM station M. Statistical values are recorded are as follows:

| | |
|---|---|
| $A_f$ | filtered amplitude of the FM station M |
| $\tilde{x}$ | statistical mean (first order moment or center of gravity) |
| $\sigma^2_H$ | variance for the high side (second order moment) |
| $\sigma^2_L$ | variance for the low side (second order moment) |
| $T_H$ | threshold for the high side |
| $T_L$ | threshold for the low side |

In steps 36 and 37, the receiver determines whether or not the instant sample of the filtered amplitude signal $A_f$ is outside the range delimited by the upper threshold $T_H$ and the lower threshold $T_L$ for more than X counts, say 5–50 consecutively. The actual number of counts may be chosen to avoid responding to transient phenomena. If neither threshold has been traversed, in steps 38 and 39 the processor 24 updates for that particular station the mean value $\tilde{x}$, and variance values $\delta^2_H$ and $\delta^2_L$ which it computes using the samples taken during the previous five minutes (15,000 samples for each of the ten stations). It then determines the lower and higher threshold values $T_L$ and $T_H$ according to the expressions:

$$T_H=\tilde{x}+T\delta^2_H \text{ and}$$

$$T_L=\tilde{x}T\delta^2_L$$

where T is a multiplier set by the user to determine sensitivity for zone N.

Had the histogram been symmetrical, the values could have been rectified and compared with a single threshold. In practice, however, it is skewed so lower and upper thresholds $T_L$ and $T_H$ are used. An intruder will cause the histogram to shift along the 'amplitude' axis quite quickly. Drift due to, for example, weather conditions is relatively slow, so false alarms due to drift are avoided by allowing the mean $\tilde{x}$ to follow the drift, which occurs because the mean is updated at sample speed, being recalculated for every new sample and thus for each FM station individually for each zone N.

If, in step 36 and 37, the signal processor 24 determines that the threshold has been exceeded for the specified count, in step 40 it sets a flag for the instant station in the "Station Alarm" mode. The conditions of the signal from the instant station i for which the receiver will signal a Station Alarm condition are:

Alarm $S_i$=1, if $A_f(T_L$ or $A_f)T_H$ for more than a count of X

No alarm $S_i$=0 otherwise

In step 41, the processor 24 determines whether or not signals for all ten stations have been processed. If not, step 42 increments the station counter and loop 43 returns the program to step 34 to select the next station. The various values determined by the processor 24 in each cycle are tabulated in Tables I and II.

| STATION M | $A_f$ |
|---|---|
| 1 | |
| 2 | |
| 3 | |
| " | |
| " | |
| " | |
| 10 | |

TABLE I

⟹

| STATION M | LAST BLOCK OF SAMPLES newest | | | | oldest |
|---|---|---|---|---|---|
| | 1 | 2 | 3 | ... | 15,000 |
| 1 | | | | | |
| 2 | | | | | |
| 3 | | | | ... | |
| " | | | | | |
| " | | | | | |
| " | | | | | |
| 10 | | | | | |

TABLE II

A sampling rate of 500 samples per second allows 50 samples for each of the ten stations. Hence, the moving sampling window of 5 minutes will accommodate 15,000 samples for each station.

When all ten stations have been processed, step 44 determines whether or not any of the stations are in the "Station Alarm" mode. If none are, step 45 resets the station counter to "1" and loop 46 returns the program to step 34 to repeat the cycle. The processor 24 records the statistical values for the ten stations as shown in Table III below:

TABLE III

| M | $\tilde{x}$ | $\sigma_L^2$ | $\sigma_H^2$ | $T_L$ | $T_H$ | STEP DETECT | ALARM COUNT | STATION ALARM |
|---|---|---|---|---|---|---|---|---|
| 1 | " | " | " | " | " | (1,0) | c | (1,0) |
| 2 | " | " | " | " | " | " | " | " |
| 3 | " | " | " | " | " | " | " | " |
| " | " | " | " | " | " | " | " | " |
| " | " | " | " | " | " | " | " | " |
| " | " | " | " | " | " | " | " | " |
| 10 | " | " | " | " | " | " | " | " |

The values $\tilde{x}$, $\delta^2_H$, $\delta^2_L$, $T_L$, $T_H$ are recorded together with an indication of whether or not a step change in the amplitude of the station's transmission has been detected, indicated by a "1" in the STEP DETECT column, the number of potential alarm conditions counted and, finally, the Station Alarm condition for each station, as a "1" or "0". The alarm count required to register a Station Alarm will be determined by the user for every zone according to the particular application. For example, if the sensor is along a rooftop, an intruder will be moving quite slowly the alarm count will be high, say 50 counts, which is the equivalent of 1 second at the rate of 50 samples per second. Where the sensor is in an open area, and the intruder could be moving quite quickly, the count could be lower, say 10 or fewer.

If step 44 indicates that one or more of the stations are in "Station Alarm" mode, step 47 assembles a Station Alarm packet as illustrated below for transmission of the alarm conditions for the different station M to the common processor 4.

| Header | Zone Address | Time | Status | Station Alarm | CRC | Tail |
|---|---|---|---|---|---|---|
| 5 bit | 8 bit | 16 bit | 3 bit | 10 bit | 3 bit | 5 bit |

The packet comprises, in succession, a header of five bits; a zone address of eight bits to identify the sensor zone for which the receiver is reporting; a time slot of 16 bits to correlate the Station Alarm temporally with those of adjacent zones; with three status bits giving an indication of conditions at the receiver, such as failure, jamming, interference, and so on; ten bits representing the alarm conditions for the ten stations; three correction bits; and finally a five bit ending or tail.

Figure 5:
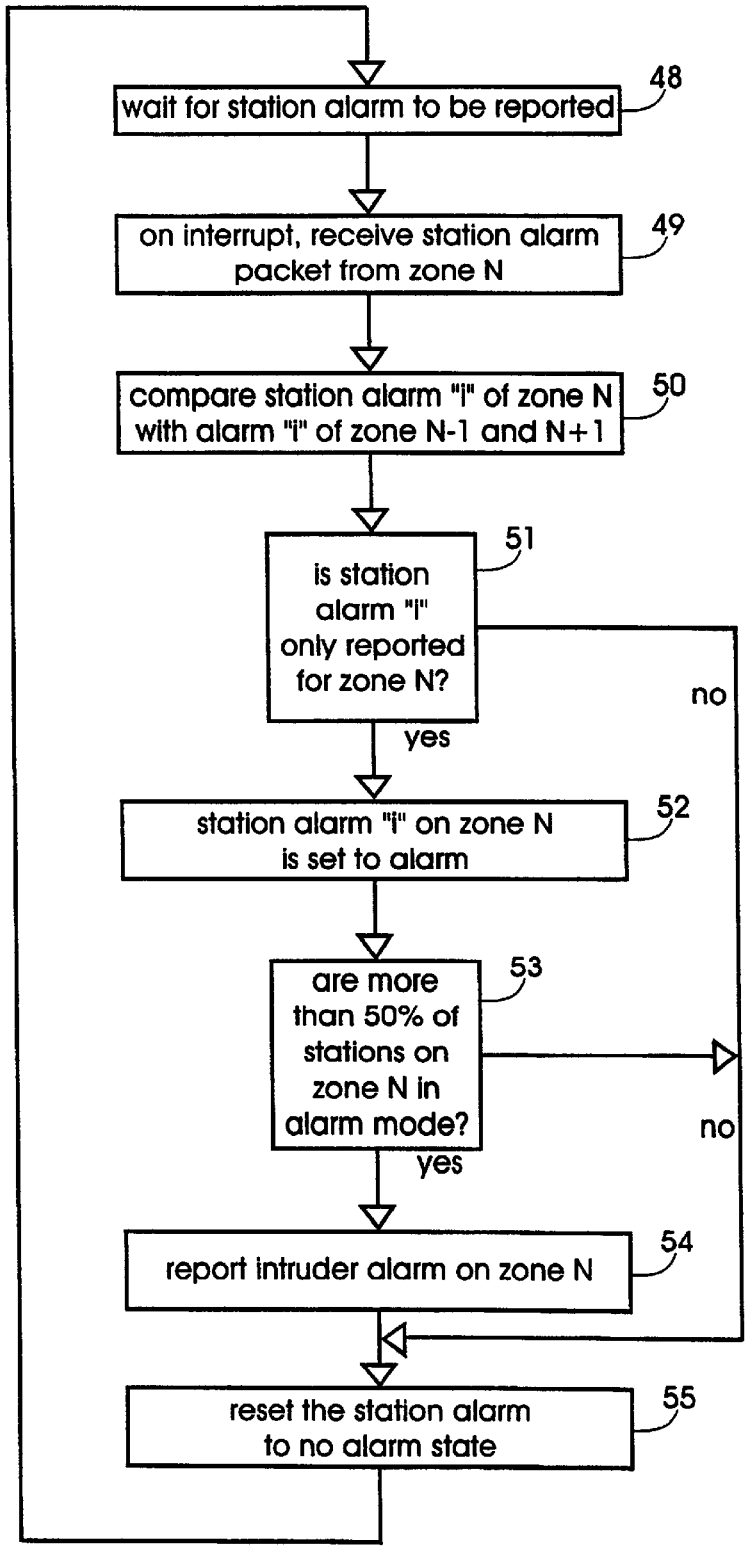
FIG. 5 is a flowchart depicting operation of a common processor of the system.

Operation of the common processor 4 upon receipt of the packets from the various receivers will now be described with reference also to the flowchart in FIG. 5. Whereas the receiver 3 scans the sensors repeatedly and continuously as described above, the common processor operates on an "interrupt" basis. Thus, in step 48, the common processor 4 is in a WAIT state awaiting a packet containing one or more Station Alarms. On receipt of such a packet in step 49, for zone N, the common processor 4 extracts from the packet the Station Alarm information and records it with the information for the other sensor zones A . . . X, mainly for N−1 and N+1 as represented by the matrix $S_{M,N}$ shown below in Table IV.

TABLE IV

| | Status of Station M Alarm at Time t | | | | | | | | | |
|---|---|---|---|---|---|---|---|---|---|---|
| Zone | 1 | 2 | 3 | 4 | 5 | 6 | 7 | 8 | 9 | 10 |
| A | (1,0) | . | . | . | . | . | . | . | . | . |
| B | . | . | . | . | . | . | . | . | . | . |
| C | . | . | . | . | . | . | . | . | . | . |
| . | . | . | . | . | . | . | . | . | . | . |
| . | . | . | . | . | $(S_{M,N})$ | . | . | . | . | . |
| N − 1 | . | . | . | . | . | . | . | . | . | . |
| N | . | . | . | . | . | . | . | . | . | . |
| N + 1 | . | . | . | . | . | . | . | . | . | . |
| . | . | . | . | . | . | . | . | . | . | . |
| . | . | . | . | . | . | . | . | . | . | . |
| X | . | . | . | . | . | . | . | . | . | . |

It is possible for the amplitude of the received signal to vary sufficiently to generate a Station Alarm without there being an intruder present, perhaps caused by a change at the transmitter or a change in weather conditions. In order to avoid such false alarms, in step 50 the common processor 4 detects a Station Alarm condition for a particular station i in the Station Alarm status bits for zone N and checks the alarm status of the same station i for the adjacent zones N−1 and N+1. Decision step 51 determines whether or not the station alarm for a particular station i is reported for the particular zone N alone. If it is not, i.e. an adjacent zone simultaneously shows a Station Alarm for the same station i, the condition is likely to be a false alarm, perhaps caused by a sudden change in the signal level at the transmitter 8 or a remote disturbance affecting many zones simultaneously, so the program goes to step 55 and resets the station alarm flag to the "NO ALARM" state, following which the program returns to step 48 and awaits receipt of another packet containing a Station Alarm.

If, however, step 51 determines that neither of the adjacent zones shows a simultaneous alarm for station i, step 52 sets a Station Alarm flag for station i and zone N. Thus:

If $S_{M,N}=1$ $S_{M,N-1}=0$ $S_{M,N+1}=0$

Then Zone N Station Alarm=1, where M is the number of stations to a maximum of 10.

In step 53, the processor 4 determines whether or not more than 50 percent of the station alarms for zone N are showing an alarm condition simultaneously. If they are not, the program returns to step 51 and processor 4 does not generate a SYSTEM INTRUDER ALARM signal for zone N. If step 52 indicates that more than 50 percent of the station alarms for zone N indicate an alarm condition, step 54 generates a SYSTEM INTRUDER ALARM signal for zone N indicating that an intruder has been detected within zone N.

Various modifications can be made to the above-described embodiment within the scope of the present invention. Thus, the processor 24 may be preprogrammed with sets of values of sensitivity T, consecutive count X, and so on per zone N for each of a number of typical applications. When setting up the system, the user may select one of the applications. The individual values may then be adjusted to take account of data collected during operation of the system. The adjustment may be effected by sending control signals to the microcontrollers via the cables.

Although the linear bus configuration of FIG. 1 is preferred, since the number of receivers and sensor cables is, theoretically, unlimited, the invention embraces other configurations. The embodiment shown in FIG. 6 comprises only two sensor cables 2A and 2B connected to receivers 3A and 3B, respectively and each terminated by a termination load 5. The receivers 3A and 3B are connected to a common processor 4 by feedlines 6A and 6B, respectively, which supply DC power and control signals to the receivers and return Station Alarm signals to the common processor 4. The receivers 3A and 3B may be similar to those illustrated in FIG. 2 but, since this embodiment does not concatenate cables, need not have provision for relaying DC power to subsequent receivers and their Station Alarm signals back to the common processor 4.

Figure 7:
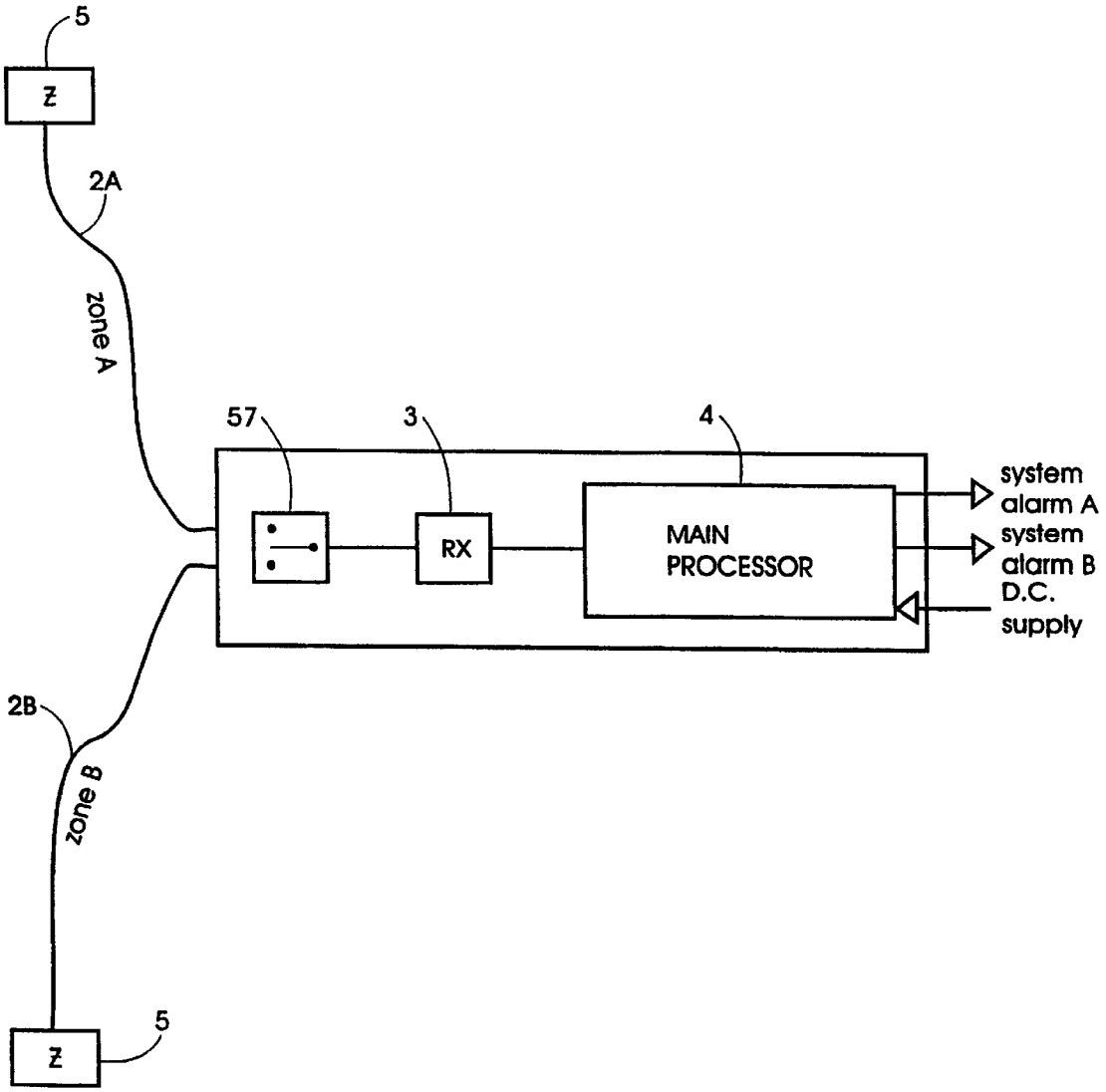
FIG. 7 is a block schematic diagram of a third embodiment of the invention.

Various other modifications are envisaged. Thus, FIG. 7 illustrates an embodiment in which, with the object of minimizing cost, a receiver 3 is combined with a common processor 4 and connected to a pair of sensor cables 2A and 2B via a multiplexer 57. The common processor 4 controls the multiplexer 57 to couple the cables 2A and 2B alternately to the receiver 3. The common processor 4 discriminates between the Station Alarms for the two cables/zones and outputs corresponding alarm signals for zones A and B.

Figure 6:
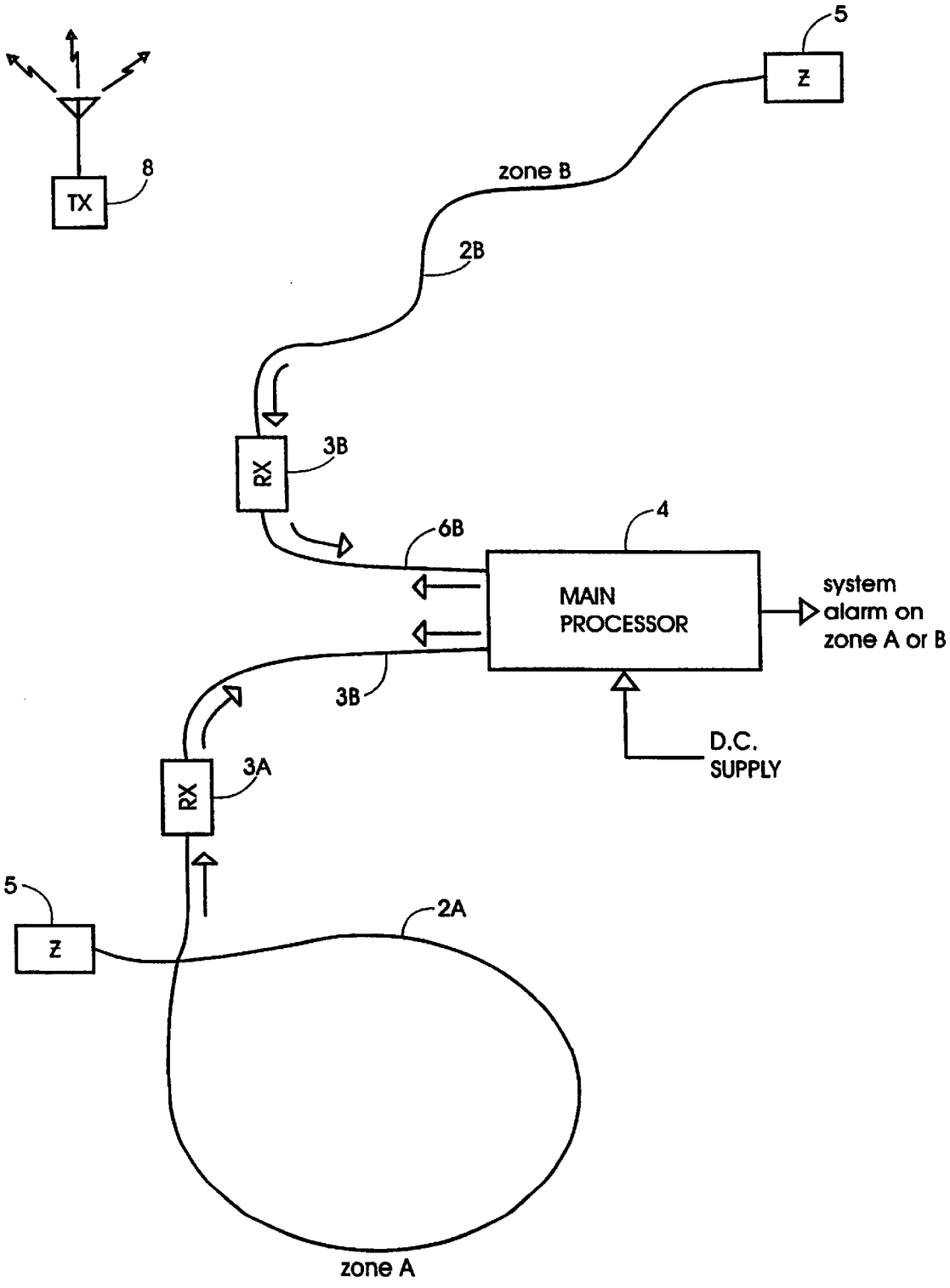
FIG. 6 is a block schematic diagram of a second embodiment of the invention.

It is also envisaged that the intrusion detection systems of FIGS. 6 and 7 could have one or more of the leaky cable sensors replaced by a localized antenna connected directly to the common processor 4. The antenna will serve as a single-point-in-space sensor to detect presence of an intruder. The common processor 4 will process signals from both the leaky cable(s) and the antenna in much the same way.

Figure 8:
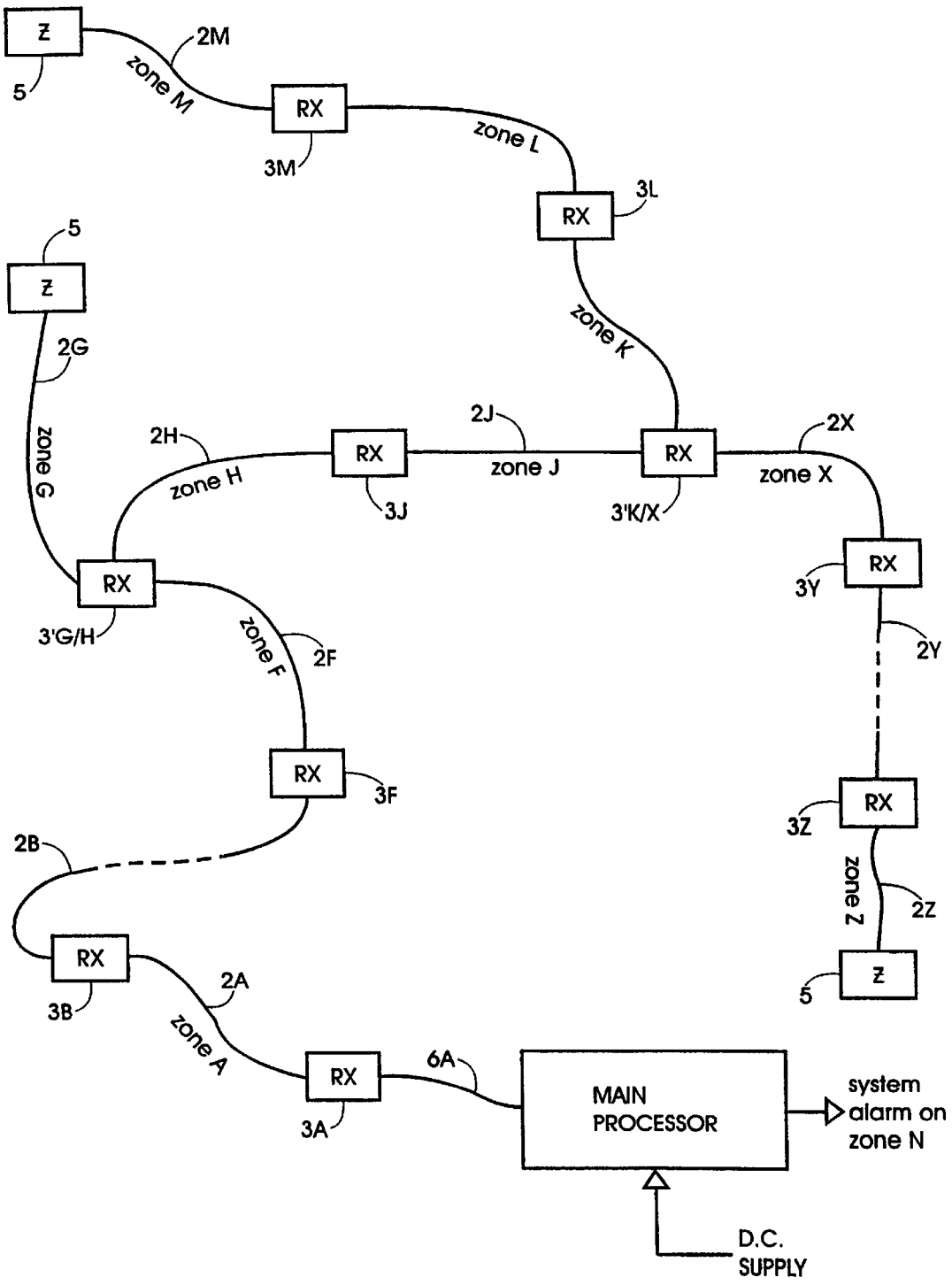
FIG. 8 is a block schematic diagram of a fourth embodiment of the invention.

The embodiment illustrated in FIG. 8 comprises receivers 3 and three-port receivers 3' connected to leaky cables in an arbitrary network topography. Receivers 3 are similar to those in FIG. 1 and connect single sensor cables in a bus configuration, as in the embodiment of FIG. 1. Three-port receivers 3' connect three cables together at a T-junction. The three-port receivers 3' may be duplicate circuitry to accommodate the additional port, or use multiplexing. The first receiver 3A is connected to the common processor 4 by a feedline 6 as before. As before, the common processor 4 supplies DC power to the receivers via the intervening sensor cables and feedlines and receives their Station Alarm signals via the same route.

Figure 9:
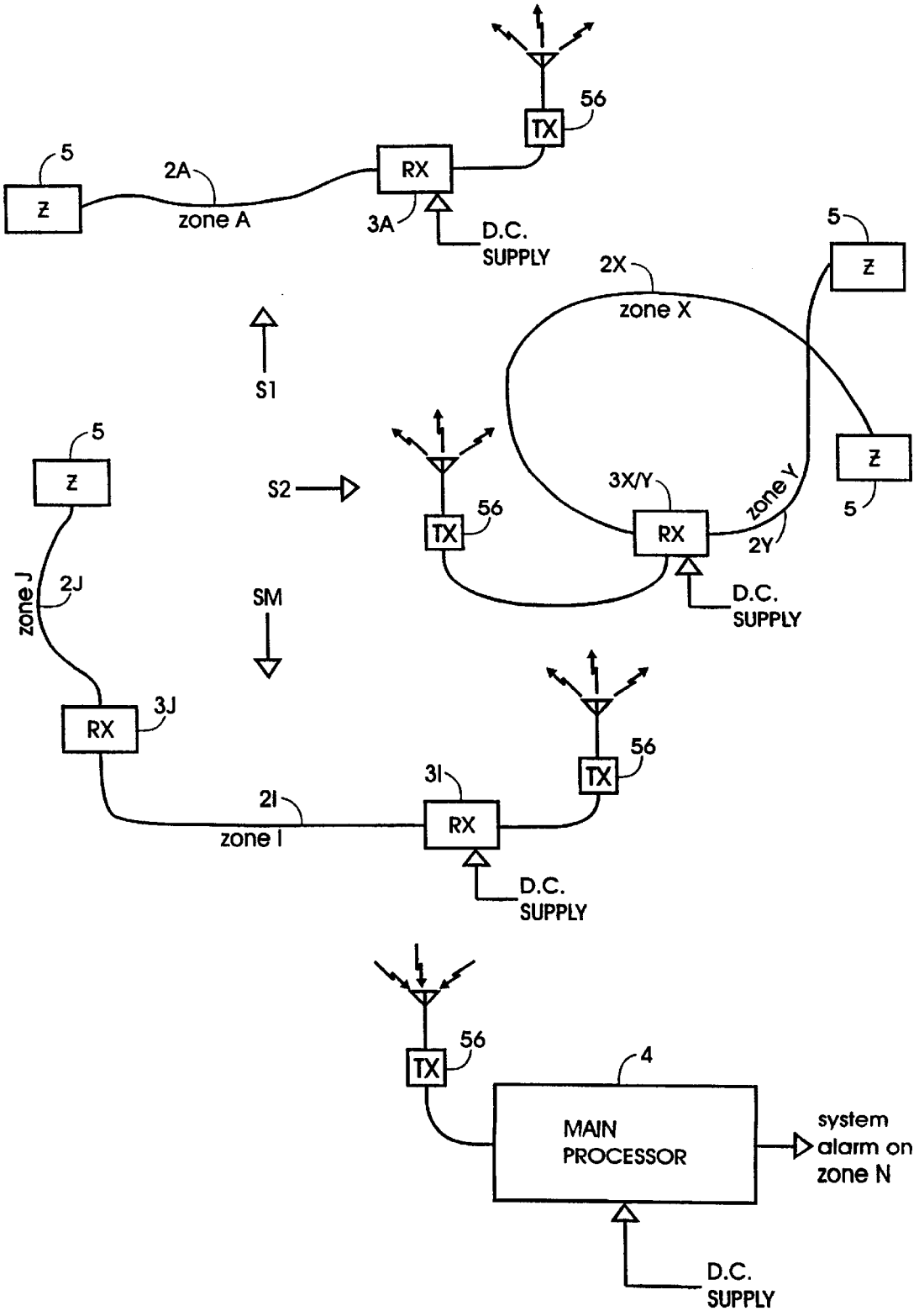
FIG. 9 is a block schematic diagram of a fifth embodiment of the invention.

The system illustrated in FIG. 9 comprises M physically separate sensor sub-systems S1, S2 . . . SM, of which only three are shown, protecting distinct areas. Sub-system S1 comprises a single cable 2A connected at one end to a receiver 3A and at its other end to a termination load 5. Sub-system S2 comprises two cables 2X and 2Y each connected to a respective termination load 5 and to respective ports of a receiver 3XY.

Third sub-system SM comprises a linear arrangement of two cables 2I and 2J connected to receivers 3I and 3J respectively. Cable 2J is terminated by a termination load 5. Receiver 3I has a DC power supply and supplies power to receiver 3J via cable 2I. As in the embodiment of FIG. 1, Station Alarm signals from receiver 3J are relayed to receiver 3I via cable 2I.

As before, the sub-systems S1, S2 . . . SM use FM radio signals broadcast from a remote, independent commercial transmitter (not shown in FIG. 7) to detect intruders and use wireless transceivers to communicate their respective Station Alarms to common processor 4. In this case, however, the receivers 3 and the common processor 4 each have a transceiver section coupled to an antenna 56 enabling the common processor 4 to transmit control signals to the receivers and receive their Station Alarm signals.

Figure 10:
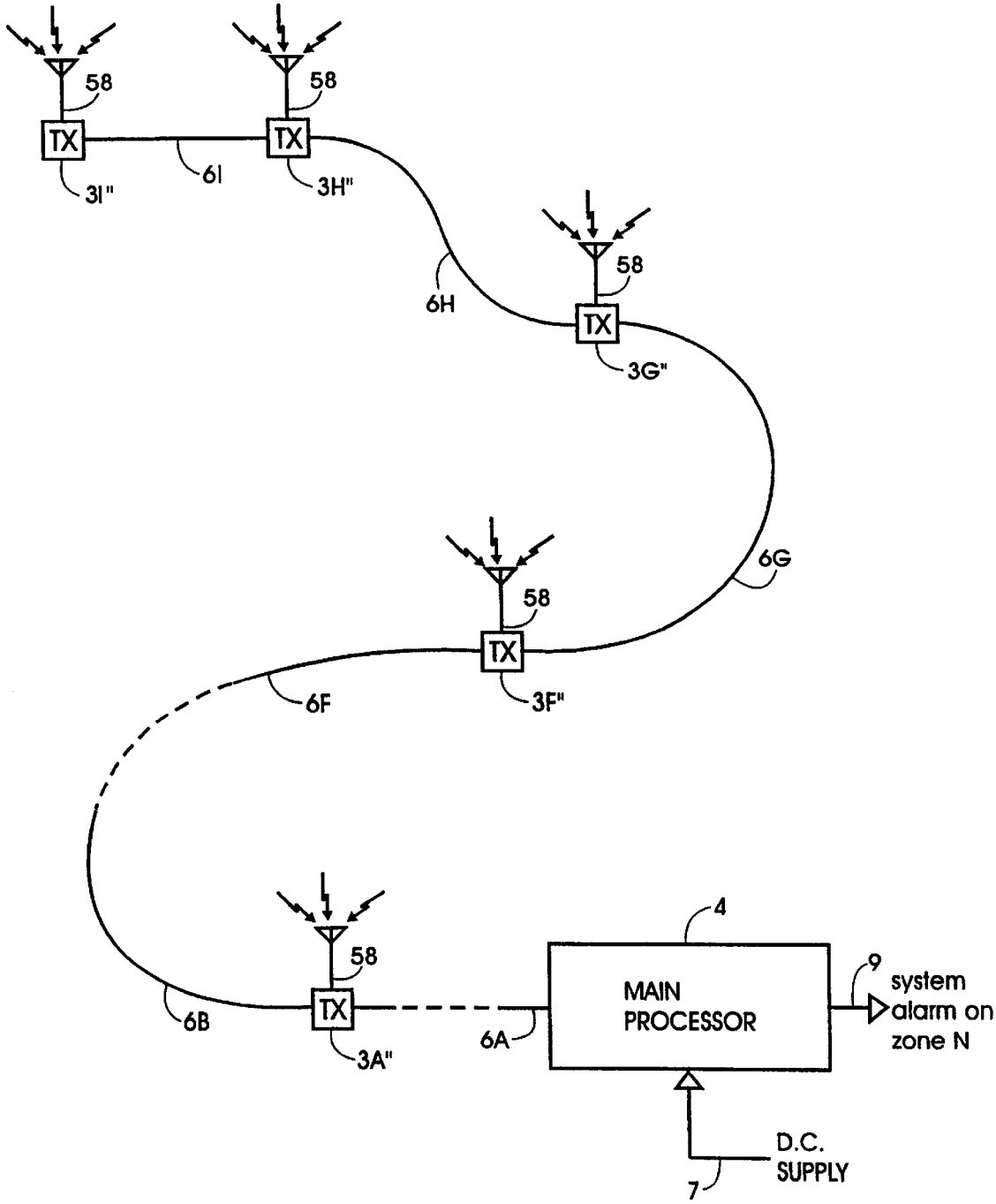
FIG. 10 is block schematic diagram of a sixth embodiment of the invention.
Figure 11:
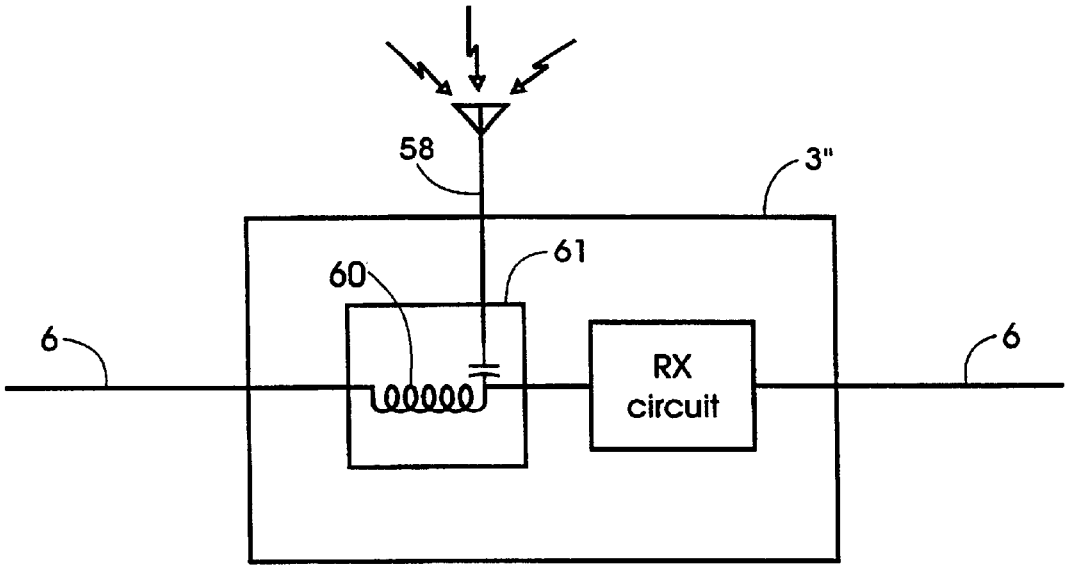
FIG. 11 illustrates in more detail a receiver of the system of FIG. 10.

FIG. 10 illustrates yet another embodiment of the invention comprising a common processor 4 and a series of receivers 3A"–3I" interconnected by a series of feedlines 6A–6I instead of leaky cables. The feedlines 6 may conveniently be standard twisted pair shielded cable. The receivers are connected to respective FM antennas 58 and form a linear bus arrangement similar to that of FIG. 1. Each FM antenna 58 receives FM signals broadcast by a remote commercial radio transmitter (not shown) and the receiver processes the signal statistically in the manner previously described to determine the presence of an intruder affecting the signal received by the associated antenna. As shown in FIG. 11, each of the receivers 3A" to 3I" has a bias-T circuit 59 at its input port. A serial inductor 60 of the bias-T circuit is connected to the feedline 6 and the branch capacitor 61 of the bias-T circuit is connected to the antenna 58, enabling DC power and control signals to be relayed via the feedlines 6 to the receivers 3A" to 3I" and their Station Alarm signals to be returned to the common processor 4 via the same path. The antennas 58 perform localized volume detection as opposed to perimeter detection.

Figure 12:
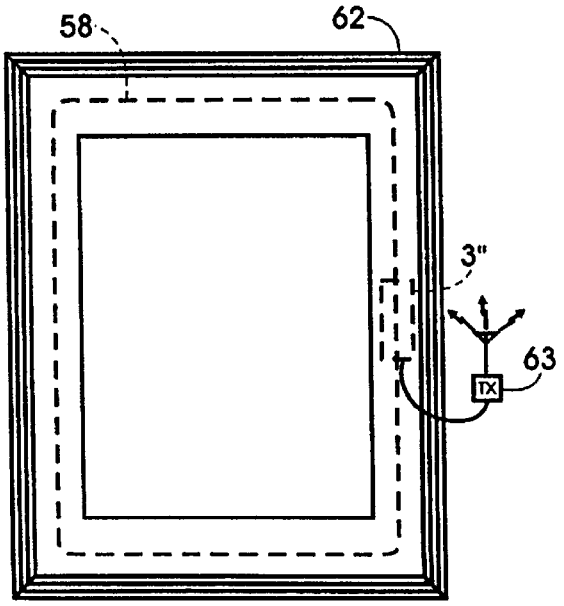
FIG. 12 illustrates a modification of the system of FIG. 10.
Figure 12:
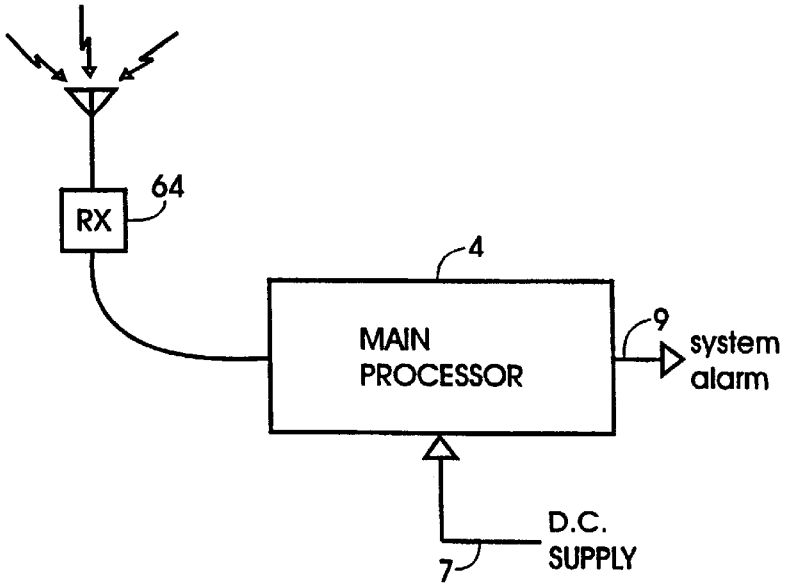

As illustrated in FIG. 12, such a FM receiver 3" and antenna 58 (in this case a loop antenna) could be mounted directly upon an article 62 to be protected to detect any motion of the article 62 itself in addition to motion of someone approaching it. The receiver 3" has a DC input terminal 63 and an antenna 58 distributed around the article 62 which serves as both a sensor to receive the FM broadcast and control signals and a transmitting antenna for communicating Station Alarm signals to the common processor 4, which has an antenna 64 for receiving Station Alarm signals and transmitting control signals to the receiver 3".

Advantageously, in any of the above-described embodiments of the invention, one or more cameras may be associated with one or more of the sensor zones to provide video surveillance in combination with the intrusion detection by leaky cables, enabling false alarms to be determined by the video surveillance systems. With such an arrangement, the detection sensitivity may be increased as compared with a stand-alone system.

It should be appreciated that, although the above-described embodiments use FM transmissions in the usual broadcast bands of 88 MHz. to 108 MHz., they could use any "man made" electromagnetic signal, for example the cellular telephone frequency in the 900 MHz. band.

It should also be appreciated that the different transmissions could emanate from different transmitters rather than the single transmitter 8 of the preferred embodiment described herein. Moreover, the system is not limited to ten station frequencies as described herein but could use practically any number.

An advantage of embodiments of the present invention which use an array or network of modules, each module comprising a segment of open transmission line and a receiver, is improved flexibility. Thus, for a particular perimeter to be protected, the user can employ different modules with different sensitivities to suit local conditions or differing media along the perimeter, such as when the line runs along the roof and sides of a building and their construction differs. Also, modular construction allows the system to be easily extended and/or adapted to take account of changes to the site, such as new construction; or readily reconfigured when moved to a new site. Individual modules can have their sensitivities adjusted or even be turned off entirely at certain times. The modular system is also less vulnerable to damage or complete shut-down.

An advantage of embodiments of the invention using a form of frequencies spectrum analysis of received signals is that the receivers are inexpensive as compared with those used in systems which use network analysis techniques to process and analyze the received signals and extract in-phase (I) and quadrature (Q) components of the modulation caused by the intruder, which involves greater complexity and cost.

An advantage of embodiments of the invention having several receivers with adjustable detection thresholds $T_L/T_H$ and successive counts X is that the user can select different detection sensitivities for the different zones simply by presetting different values of multiplier T and count X for different receivers. Also, higher sensitivity can be used for zones which are also monitored by cameras, in which case a greater number of false alarms from the intrusion detection system can be tolerated.

Although embodiments of the invention have been described and illustrated in detail, it is to be clearly understood that the same are by way of illustration and example only and not to be taken by way of the limitation, the spirit and scope of the present invention being limited only by the appended claims.

INDUSTRIAL APPLICABILITY

Embodiments of the invention may be used to monitor military, commercial or residential property for unauthorized entry by intruders.

What is claimed is:

1. An intrusion detection system comprising a plurality of sensors each coupled to a respective one of a corresponding plurality of receivers, each receiver having means for receiving from the associated sensor a radio frequency signal having a multiplicity of transmissions at different frequencies within a predetermined frequency spectrum, and being arranged to detect said multiplicity of transmissions, each of the plurality of receivers having computing means for periodically determining, for each of said multiplicity of transmissions, a corresponding signal amplitude measurement, comparing each signal amplitude measurement for each of the different frequencies with at least one preset threshold value and, if the amplitude exceeds the threshold value for a predetermined time period, indicating a potential alarm condition, the system further comprising means (4) for monitoring each of the plurality of receivers for potential alarm conditions and signalling an actual alarm condition when a particular receiver indicates potential alarm conditions for a predetermined number of different transmission frequencies within the same time period.

2. An intrusion detection system as claimed in claim 1, wherein at least one of the sensors comprises a localized antenna.

3. An intrusion detection system as claimed in claim 1, wherein the receivers are arranged in a plurality of sub-systems each comprising one more of said receivers, and wherein the monitoring means comprises a common processor, the sub-systems being physically separated from each other, the Rub-systems and the common processor having respective receivers for communicating alarm signals from each sub-system to the common processor.

4. An intrusion detection system as claimed in claim 1, wherein said predetermined frequency spectrum is from about 88 MHz. to 108 MHz.

5. An intrusion detection system as claimed in claim 1, wherein each receiver includes means for scanning an FM radio spectrum and selecting a number of said transmission frequencies, and the computing means is arranged to sample the amplitude of the FM radio signal received from the associated sensor over a predetermined time interval, each sample being said signal amplitude measurement, derive statistics of a plurality of said samples over each of successive time periods, and adjust the preset threshold value periodically in dependence upon said statistics.

6. An intrusion detection system as claimed in claim 5, wherein the computing means is arranged to compare each signal amplitude measurement with an upper preset threshold value and a lower preset threshold value, determine higher and lower variance values of the plurality of amplitude samples update the upper and lower thresholds in dependence upon the upper and lower variance, respectively, and indicate said potential alarm condition when a predetermined number of said amplitude samples are outside a range defined by the upper and lower thresholds.

7. An intrusion detection system as claimed in claim 1, wherein the monitoring means comprises a processor unit having means for receiving data about said potential alarm conditions from said receivers, the receivers each having means for transmitting said data to the processor unit, the processor unit being arranged to signal said actual alarm condition when potential alarm conditions from a particular receiver occur for at least a predetermined proportion of said multiplicity of transmissions in a predetermined time interval.

8. An intrusion detection system as claimed in claim 1, wherein the monitoring means comprises a common processor for comparing potential alarm condition states for a particular sensor with corresponding potential alarm condition states of at least one immediately neighbouring sensor and determining an intrusion to have occurred if the potential alarm condition for said particular station does not coincide with an alarm signal for said at least one immediately neighbouring sensor.

9. An intrusion detection system as claimed in claim 8, wherein each sensor comprises an open transmission line, a first receiver being connected to the common processor for processing signals from the different receivers, each of the subsequent receivers interconnecting two of the open transmission lines, each receiver being arranged to relay potential intruder alarms signal from later receivers to the common processor by way of any intervening open transmission lines and receivers.

10. An intrusion detection system as claimed in claim 9, wherein the common processor is arranged to supply power to the receivers by way of the intervening transmission line.

11. An intrusion detection system comprising a, plurality of sensors coupled to a corresponding plurality of receivers, each receiver to receive a radio frequency signal from the associated sensor, the radio frequency signal having a multiplicity of transmissions at different frequencies within a predetermined frequency spectrum, the receiver being arranged to receive said transmissions and having computing means for determining, for each of said multiplicity of transmissions, corresponding signal amplitude measurements, comparing each of such signal amplitude measurements for a particular one of the different frequencies with at least one preset threshold value and, if the amplitude exceeds the threshold value for a predetermined time period, indicating a potential alarm condition, wherein the receiver includes means for scanning an FM radio spectrum and selecting a number of said transmission frequencies, and the computing means is arranged to sample the amplitude of the FM radio signal received from the associated sensor over a predetermined time interval, each sample being said signal amplitude measurement, derive statistics of a plurality of Said samples over each of successive time periods, and adjust the preset threshold value periodically in dependence upon said statistics.

12. An intrusion detection system as claimed in claim 11, wherein the computing means is arranged to compare each signal amplitude measurement with an upper preset threshold value and a lower preset threshold value, determine higher and lower variance values of the plurality of amplitude samples update the upper and lower thresholds in dependence upon the upper and lower variance, respectively, and generate said potential intruder alarm signal when a predetermined number of said amplitude samples are outside a range defined by the upper and lower thresholds.

13. An intrusion detection system comprising a plurality of sensors coupled to a corresponding plurality of receivers, each receiver to receive a radio frequency signal from the associated sensor, the radio frequency signal having a multiplicity of transmissions at different frequencies within a predetermined frequency spectrum, the receiver being arranged to receive said transmissions and having computing means for determining, for each of said multiplicity of transmissions, corresponding signal amplitude measurements, comparing each of such signal amplitude measurements for a particular one of the different frequencies with at least one preset threshold value and, if the amplitude exceeds the threshold value for a predetermined time period, indicating a potential alarm condition, wherein the computing means is arranged to compare indications of potential alarm conditions for a plurality of said transmissions and generate an alarm when potential alarm conditions occur for at least a predetermined proportion of said multiplicity of transmissions in a predetermined time interval.

14. An intrusion detection system comprising a plurality of sensors coupled to a corresponding plurality of receivers, each receiver to receive a radio frequency signal from the associated sensor, the radio frequency signal having a multiplicity of transmissions at different frequencies within a predetermined frequency spectrum, the receiver being arranged to receive said transmissions and having computing means for determining, for each of said multiplicity of transmissions, corresponding signal amplitude measurements, comparing each of such signal amplitude measurements for a particular one of the different frequencies with at least one preset threshold value and, if the amplitude exceeds the threshold value for a predetermined time period, indicating a potential alarm condition, and a common processor for comparing alarm signal states for a particular sensor with corresponding alarm signal states of at least one immediately neighbouring sensor and determining an intrusion to have occurred if the alarm signal for said particular station does not coincide with an alarm signal for said at least one immediately neighbouring sensor.

15. An intrusion detection system as claimed in claim 14, wherein each sensor comprises an open transmission line, a first receiver being connected to the common processor for processing signals from the different receivers, each of the subsequent receivers interconnecting two of the open transmission lines, each receiver being arranged to relay potential intruder alarms signal from later receivers to the common processor by way of any intervening open transmission lines and receives.

16. An intrusion detection system as claimed in claim 15, wherein the common processor is arranged to supply power to the receivers by way of the intervening transmission line.

* * * * *